US007438440B2

(12) United States Patent
Dorogi

(10) Patent No.: US 7,438,440 B2
(45) Date of Patent: Oct. 21, 2008

(54) LAMP THERMAL MANAGEMENT SYSTEM

(75) Inventor: Michael Jay Dorogi, Newark, OH (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 11/410,644

(22) Filed: Apr. 25, 2006

(65) Prior Publication Data

US 2007/0247853 A1 Oct. 25, 2007

(51) Int. Cl.
*F21V 29/00* (2006.01)

(52) U.S. Cl. ..... 362/294; 362/264; 362/373

(58) Field of Classification Search ..... 362/96, 362/218, 263, 264, 294, 373, 547; 313/44, 313/45, 46

See application file for complete search history.

(56) References Cited

U.S. PATENT DOCUMENTS

| | | | | |
|---|---|---|---|---|
| 3,639,751 | A * | 2/1972 | Pichel | 362/294 |
| 4,411,516 | A * | 10/1983 | Adachi et al. | 362/218 |
| 4,829,412 | A | 5/1989 | Pavelin | 362/294 |
| 4,879,638 | A | 11/1989 | Pavelin | 362/294 |
| 5,006,752 | A | 4/1991 | Eggink et al. | 313/161 |
| 5,130,912 | A | 7/1992 | Friederichs et al. | 362/263 |
| 5,174,646 | A | 12/1992 | Siminovitch et al. | 362/218 |
| 5,335,054 | A | 8/1994 | Landa | 355/279 |
| 5,422,456 | A | 6/1995 | Dahm | 219/121 |
| 5,563,391 | A | 10/1996 | Dahm | 219/121 |
| 5,848,080 | A | 12/1998 | Dahm | 372/25 |
| 5,851,339 | A | 12/1998 | Rucker | 156/290 |
| 5,870,421 | A | 2/1999 | Dahm | 372/75 |
| 6,081,070 | A | 6/2000 | Popov | 313/490 |
| 6,330,259 | B1 | 12/2001 | Dahm | 372/35 |
| 6,667,567 | B2 | 12/2003 | Fujishiro | 313/46 |
| 6,774,544 | B2 | 8/2004 | Kim | 313/46 |
| 6,784,601 | B2 * | 8/2004 | Kai et al. | 362/264 |
| 6,974,233 | B1 * | 12/2005 | Aubrey | 362/294 |
| 2002/0135741 | A1 | 9/2002 | Lee | 353/61 |
| 2003/0222557 | A1 | 12/2003 | Kurachi | 313/46 |
| 2004/0004422 | A1 | 1/2004 | Claus | 315/248 |
| 2004/0120148 | A1 * | 6/2004 | Morris et al. | 362/373 |
| 2004/0169451 | A1 | 9/2004 | Oishi et al. | 257/99 |
| 2004/0213016 | A1 | 10/2004 | Anderson et al. | 362/547 |
| 2004/0252502 | A1 | 12/2004 | McCullough | 362/345 |

* cited by examiner

*Primary Examiner*—Y My Quach Lee
(74) *Attorney, Agent, or Firm*—Ballard Spahr Andrews & Ingersoll, LLP

(57) ABSTRACT

The invention relates to a thermal management system for a lamp. The system comprises a lamp socket that comprises a socket body. The thermal assembly is in thermal communication with the socket body to form a thermal circuit between the lamp and the thermal assembly for dissipating heat generated by the lamp.

19 Claims, 5 Drawing Sheets

LAMP THERMAL MANAGEMENT SYSTEM

FIELD OF THE INVENTION

The present invention pertains to a thermal management system for a lamp. More specifically, the invention relates to an apparatus and method for dissipating heat from a variety of lamp types.

BACKGROUND OF THE INVENTION

There are a variety of lamps used in the lighting industry. Some examples are high intensity discharge (HID), fluorescent, LED, induction and incandescent. Each of these lamps emits energy in the form of radiant energy and heat in various amounts. For example, a 400 watt metal halide lamp converts approximately 110 watts to visible energy, 20 watts to UV energy, 70 watts to IR energy, while the remaining 200 watts of energy is converted to heat and dissipated to the surrounding environment via conduction through the lamp base and convection off the glass envelope.

A significant amount of energy is converted to heat by the lamp. In any luminaire design, the heat generated by the lamp can cause problems related to the basic function of the lamp and luminaire. The benefit of effective removal of thermal energy from within the luminaire will be improved luminaire life, smaller package sizes, and in some cases, better lumen output. An additional benefit to removing heat from the luminaire is that the luminaire can then be operated in a higher ambient temperature environment without compromising life or performance.

There are three mechanisms by which thermal energy from the lamp is dissipated: conduction, convection, and radiation. Conduction occurs where physical contact is made between mounting components of the lamp to the lamp housing. Traditional means of providing electrical and mechanical contact between lamp and luminaire provide poor means for conduction to occur between the lamp and external luminaire surfaces. In addition, the location of the lamp and socket are often determined by the desired optical performance of the luminaire. This often necessitates that the socket and lamp be mounted on bosses or other structures that further impede the conductive transfer of heat out of the luminaire envelope, either by creating a longer thermal path, introducing additional thermal interfaces, introducing materials with a lower thermal conductivity, or some combination thereof.

Convection can occur at any surface exposed to air and is limited by the movement of air around the lamp and the difference between the temperature of the lamp surface and the air surrounding it. In many cases, the luminaire may be enclosed, which further exacerbates heat related failures. For example, in luminaires with electronic ballasts and components, the excessive heat can shorten the life of the electronic components causing premature failure of the lighting system.

Radiation is the movement of energy from one point to another via electromagnetic propagation. Much of the radiant energy escapes a luminaire through the optical elements and reflectors. What radiant energy that does not escape is absorbed by the various materials within the luminaire and converted into heat.

Of these three modes of thermal transfer, providing an effective conduction path often allows the greatest amount of controlled heat removal from within a luminaire. This is especially pertinent for luminaires that are enclosed to meet the requirements of the application. Open luminaires can provide good convective energy transfer, but due to limitations of luminaire construction or other application requirements, cannot always provide adequate cooling of the luminaire.

The socket and lamp of many of these luminaire are mounted directly to the lamp housing. The lamp housing contains thermally sensitive electronic components. Even though the luminaire is "open"—a significant amount of heat is transferred to the lamp housing via conduction and convection. By providing an alternative conduction path and dissipation area, a significant reduction in thermal transfer to the lamp housing can be implemented. Good thermal management based on conduction of energy from lamp should be considered.

SUMMARY

The present invention pertains to a lighting assembly for use with an induction lamp. Induction lamps do not have sockets per se, they mount directly to a mount body within the luminaire via the engagement end of the lamp. The mount body is, therefore, configured to receive the engagement end of the lamp.

The lighting assembly also comprises a thermal assembly that is used to dissipate heat from the lamp. A portion of the thermal assembly is in thermal communication with the mount body to form a thermal circuit between the lamp and the thermal assembly. In one aspect, the thermal assembly is configured to dissipate heat from the lamp to the surrounding environment. In another aspect, the thermal assembly is configured to selectively dissipate heat from the lamp to the surrounding environment.

DETAILED DESCRIPTION OF THE DRAWINGS

These and other features of the preferred embodiments of the present invention will become more apparent in the detailed description, in which reference is made to the appended drawings wherein.

DETAILED DESCRIPTION OF THE INVENTION

Figure 1:
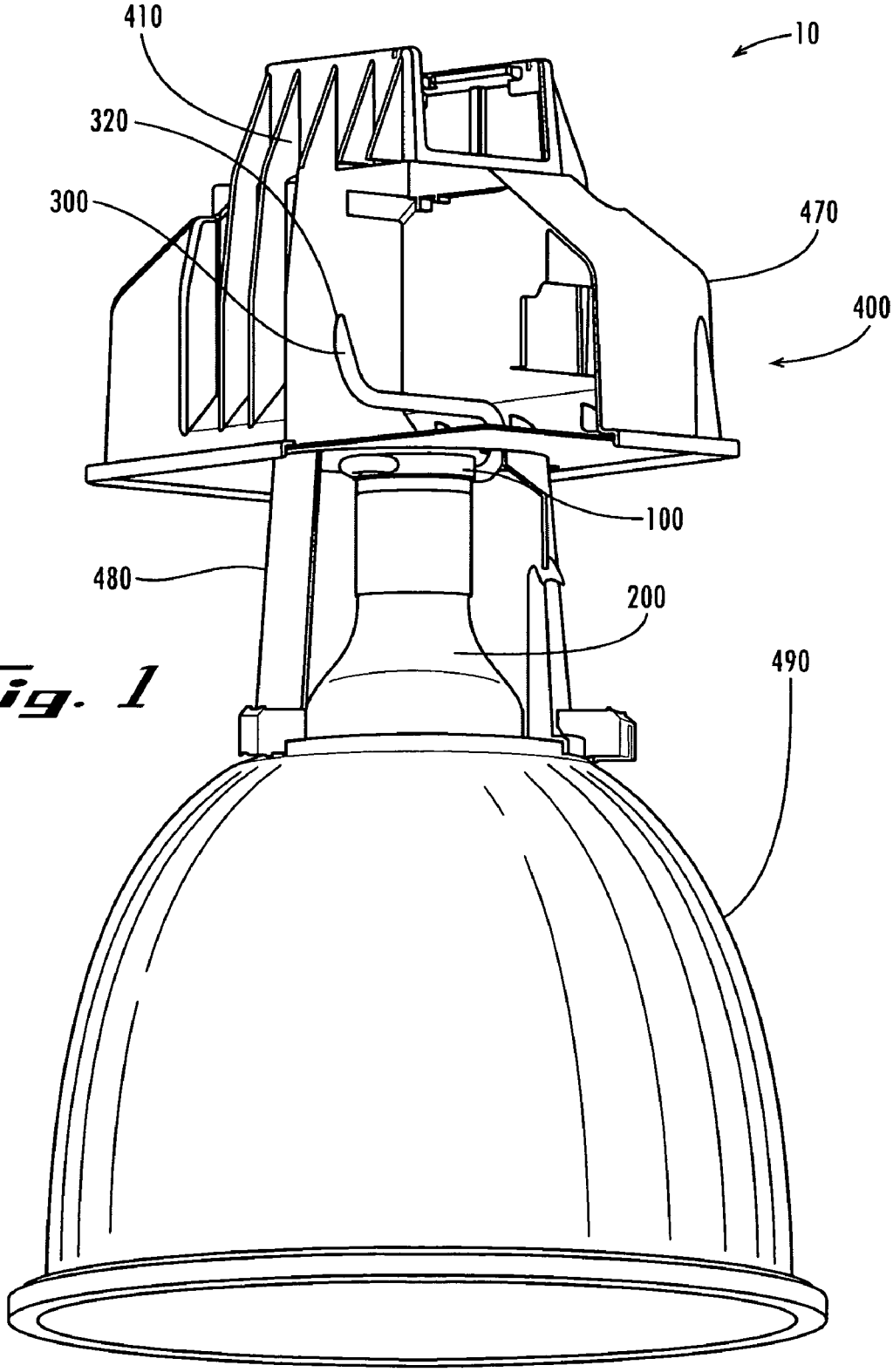
FIG. 1 is a partially transparent perspective view of one embodiment of the present invention for a lighting assembly showing a thermal assembly in thermal communication with a mount body and with the luminaire housing.
Figure 2:
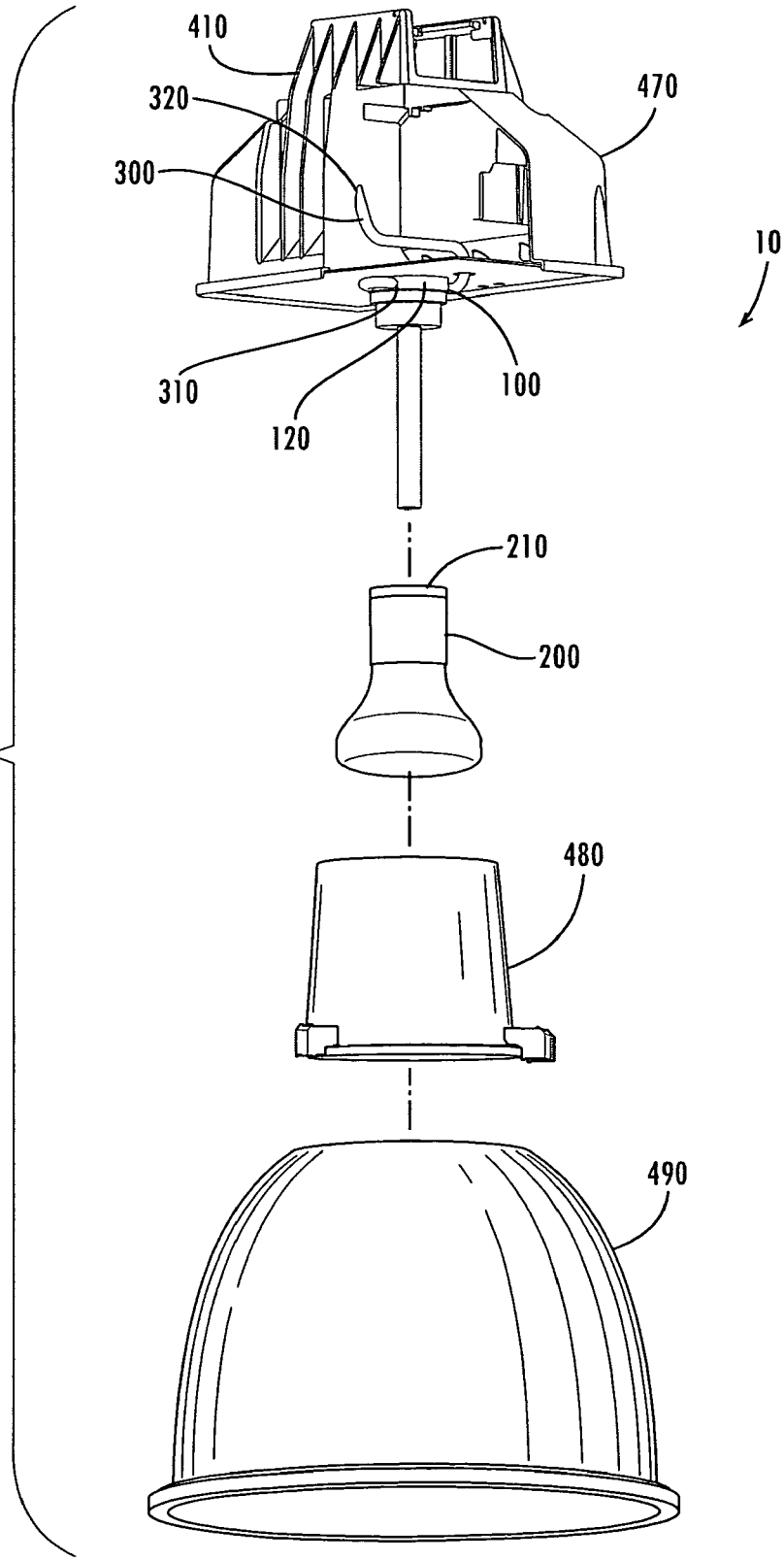
FIG. 2 is a partially transparent exploded perspective view of the lighting assembly of FIG. 1, showing a housing comprising a ballast housing, a husk, and a reflector.
Figure 3:
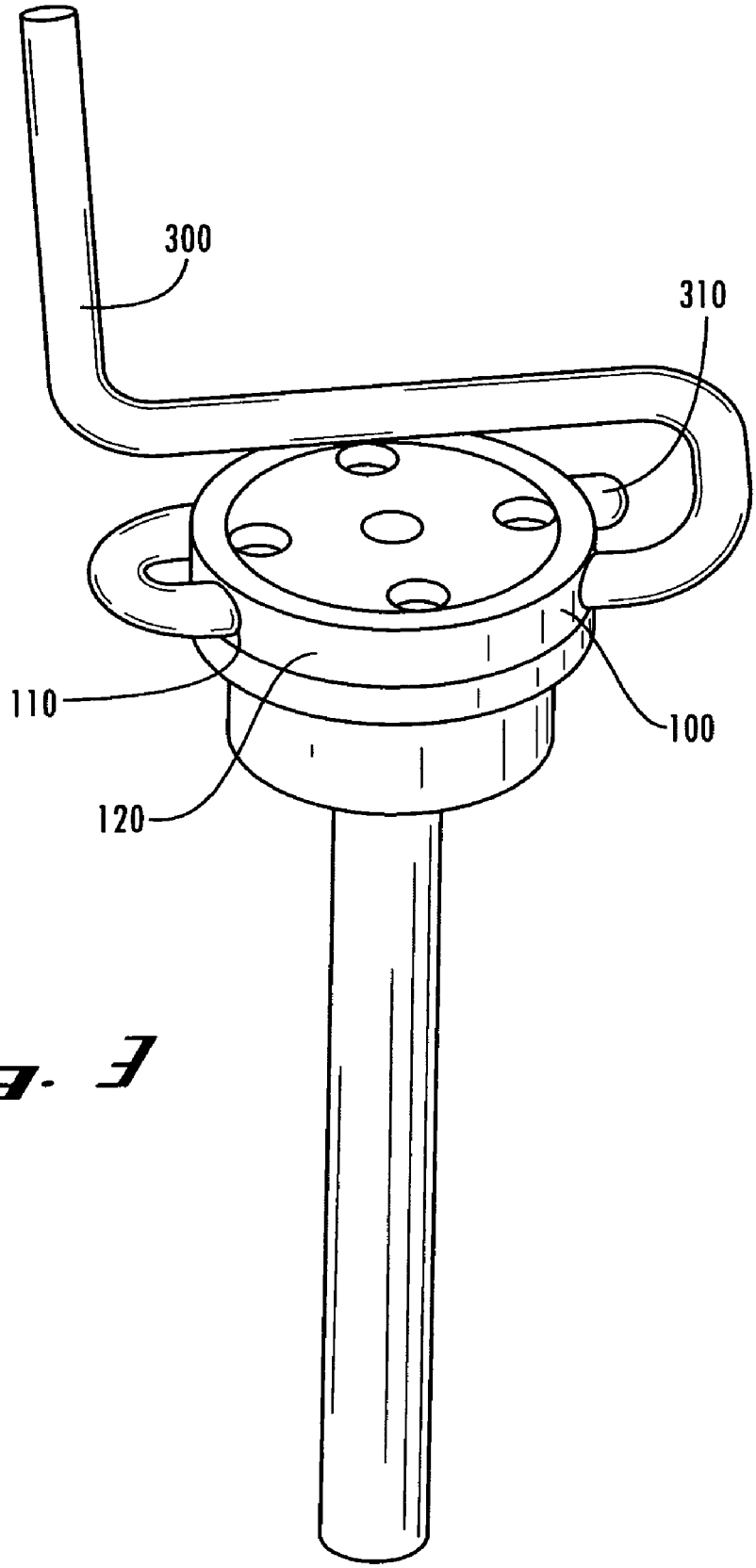
FIG. 3 is a perspective view of a portion of the thermal assembly of FIG. 1 in thermal communication with a mount body.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "surface" includes aspects having two or more such surfaces unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of preferred embodiments of the invention and the examples included therein and to the Figures and their previous and following description.

The invention is a lighting assembly 10 for use with an induction lamp 200. Induction lamps do not have sockets per se, they mount directly to a mount body 100 within the luminaire via the engagement end 210 of the lamp 200. The mount body 100 is, therefore, configured to receive the engagement end 210 of the lamp.

The lighting assembly 10 also comprises a thermal assembly 300 that is used to dissipate heat from the lamp 200. A portion of the thermal assembly is in thermal communication with the mount body to form a thermal circuit between the lamp and the thermal assembly 300. In one aspect, the thermal assembly is configured to dissipate heat from the lamp to the surrounding environment. In another aspect, the thermal assembly is configured to selectively dissipate heat from the lamp to the surrounding environment.

In one aspect of the invention, the thermal assembly 300 is a heat pipe. As one skilled in the art will appreciate, heat pipes are used in a variety of applications to dissipate thermal energy. In this aspect of the invention, the heat pipe may be connected to the mount body in any of a variety of fashions as long as a portion of the heat pipe is in thermal communication with the mount body 100. In one aspect, the mount body comprises a thermally conductive material, such as, but not limited to aluminum, copper, and the like.

In another aspect of the invention, the thermal assembly 300 is a variable conductance heat pipe (VCHP). The VCHP can selectively dissipate heat. A VCHP operates on the same principles as a conventional heat pipe, except that a reservoir containing a non-condensable gas is added to the heat pipe. By controlling the amount of non-condensable gas inside the reservoir and by careful selection of the heat dissipating area of the heat pipe, a differential thermal transfer is achieved. A boundary region exists between the non-condensable gas and the vaporized working fluid. The location of this boundary region depends on the amount of heat added to the system. At temperatures below the lower end of the desired temperature range, the boundary region is designed to be within the area of the heat pipe where there is no heat dissipating structure. In this case there will be very little heat transfer. Once the mount body reaches the upper limit of the desired temperature range, the boundary region of the VCHP will move into the area of heat pipe where the heat dissipating structure exists. When this occurs, thermal energy begins to be dissipated. This point is called the set point of the VCHP. As more heat is added, the boundary region moves further and further into the heat dissipating structure allowing greater rejection of heat.

In yet another embodiment, the thermal assembly can be a thermal actuator (not shown) in conjunction with a conventional heat pipe. This combination creates a mechanical assembly that makes and breaks the thermal transfer path between the mount body and the conventional heat pipe. A thermal actuator is a device filled with a wax-like solid that changes from solid to a liquid at a certain temperature. The wax-like material occupies a larger volume in liquid state than in a solid state. When the phase change occurs, the material exerts a force on its container walls. The assembly, as can be appreciated, can be constructed in many ways. One way is to design it such that when expansion occurs, it exerts pressure against a sealed but flexible container wall. A cylindrical rod or plunger can be positioned exterior to the container wall such that expansion of the wax-like material, in turn, moves the container wall to move the plunger. The plunger, in turn, can move a small wedge constructed of a thermally conductive material into a position that completes a thermal path between the mount body 100 and the heat pipe. Thermal actuators and conventional heat pipes are well known in other applications and will not be discussed further. Exemplary thermal actuators are manufactured and sold by Thermo-Omega-Tech, Inc., Caltherm Corporation, and others.

In still another embodiment, the thermal assembly 300 can be a localized synthetic jet actuator (SJA) (not shown). An SJA is an air jet generator that requires zero mass input yet produces non-zero momentum output. The basic components of a SJA are a cavity and an oscillating material. A jet is synthesized by oscillatory flow in and out of the cavity via an orifice in one side of the cavity. The flow is induced by a vibrating membrane located on one wall of the cavity. There are many types of actuators that can be used in active flow control, such as thermal, acoustic, piezoelectric, electromagnetic and shape memory alloys. One example of an SJA is well known in the computer field and has been developed by the Georgia Tech Research Corporation and commercialized by Innovative Fluidics, Inc.

In one aspect, a piezoelectric material is chosen to drive the oscillating diaphragm. Flow enters and exits the cavity through the orifice by suction and blowing. On the intake stroke, fluid is drawn into the cavity from the area surrounding the orifice. During one cycle of oscillation, this fluid is expelled out of the cavity through the orifice as the membrane moves upwards. Due to flow separation, a shear layer is formed between the expelled fluid and the surrounding fluid. This layer of vorticity rolls up to form a vortex ring under its own momentum. By the time the diaphragm begins to move away from the orifice to pull fluid back into the cavity, the vortex ring is sufficiently distant from the orifice that it is virtually unaffected by the entrainment of fluid into the cavity. Thus, over a single period of oscillation of the diaphragm, while there is zero net mass flux into or out of the cavity, there is also a non-zero mean momentum flux. This momentum is, effectively, a turbulent-like jet that has been synthesized from the coalescence of a train of vortex rings, or vortex pairs, of the ambient fluid. Flow control can be achieved using traditional devices such as steady and pulsed jets. The obvious benefit of employing SJAs as a flow control device is that they require no air supply and so there is no need for piping, connections, and compressors associated with steady jets. They also consume very little energy.

In one aspect of the invention, the mount body defines at least one bore 110 extending at least partially through it. In another aspect, a proximal portion 310 of the thermal assembly is mounted within at least a portion of the bore 110 and is in thermal communication with the mount body. In yet another aspect, at least a portion of the proximal portion 310 of the thermal assembly extends out of the one bore. In still another aspect, a proximal portion of the thermal assembly is integrally mounted within a portion of the mount body 100. In a further aspect, at least a portion of the proximal portion of the thermal assembly 300 is connected to an exterior portion 120 of the mount body.

The lighting assembly 10, in one aspect, further comprises a lamp housing 400, within which the mount body is disposed. As one skilled in the art can appreciate, in one aspect, the lamp housing comprises a ballast housing 470, husk 480, and reflector 490.

In another aspect, a portion of the thermal assembly is in thermal communication with a portion of the lamp housing 400, completing a thermal circuit between the mount body and the lamp housing. A portion of the lamp housing 400 may comprise a thermally conductive material and it may also comprise a plurality of fins 410. The thermally conductive material enables the housing to assist in the thermal dissipation. Additionally, when the housing comprises fins 410, these fins provide additional surface area with which to dissipate thermal energy. In fact, in one aspect, a distal portion 320 of the thermal assembly is embedded within at least a portion of the fins. Alternately, a distal portion 320 of the thermal assembly is connected to at least a portion of the fins.

Figure 4:
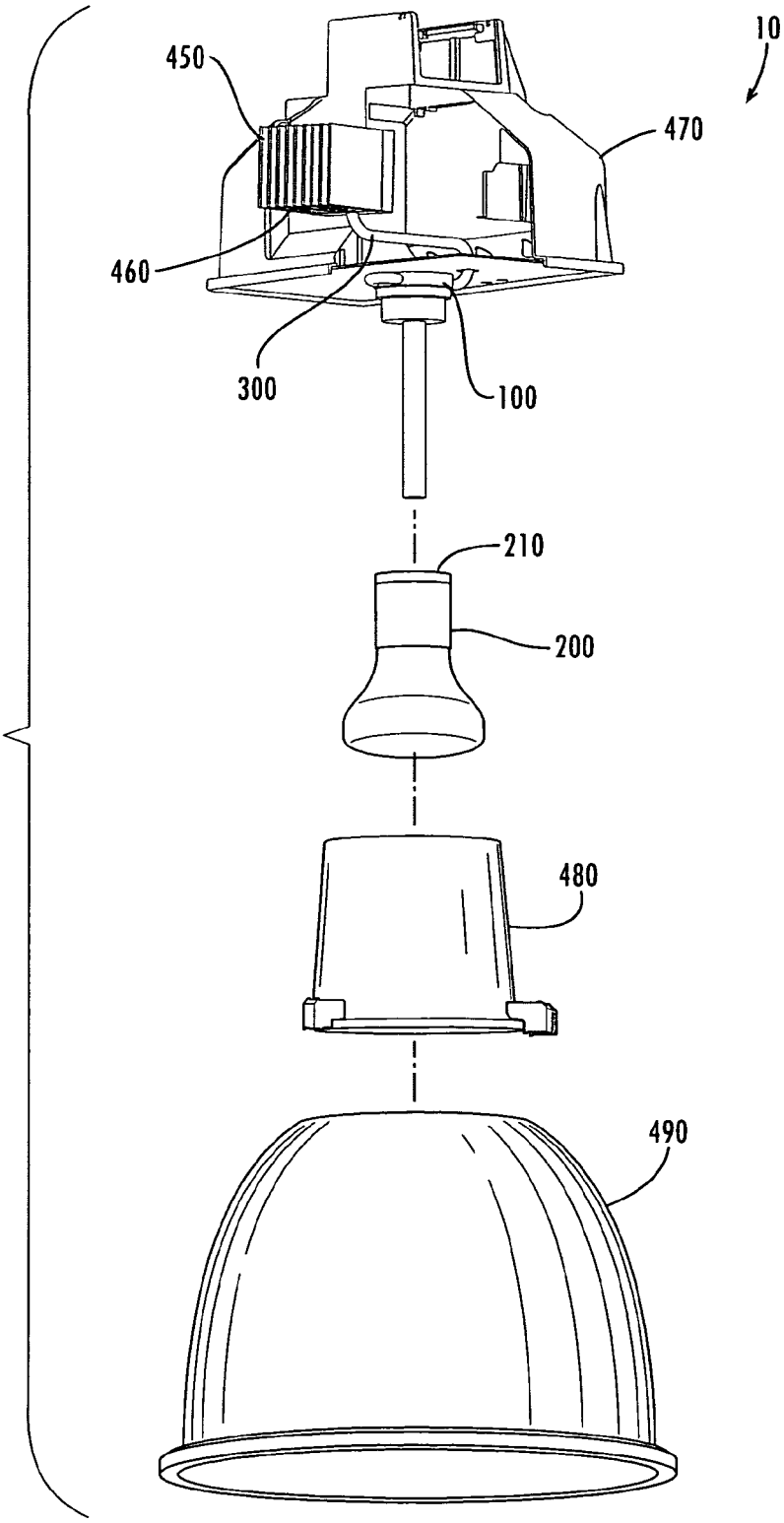
FIG. 4 is a partially transparent exploded perspective view of the lighting assembly of FIG. 1 showing a dissipative member.
Figure 5:
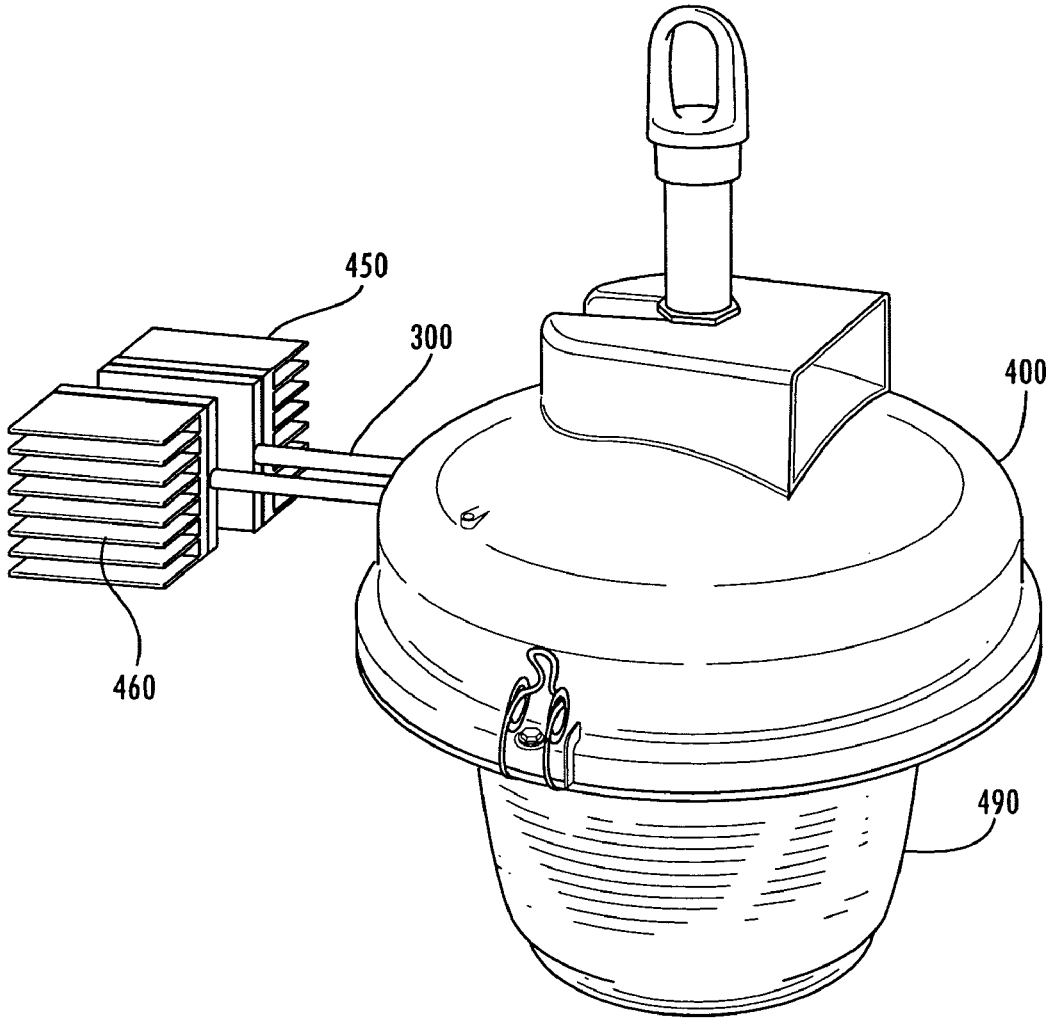
FIG. 5 is a perspective view of one embodiment of the present invention for a lighting assembly showing a thermal assembly in thermal communication with a dissipative member which is located remotely from the housing.

In another aspect, as illustrated in FIGS. 4 and 5, the lighting assembly further comprises a dissipation member 450 located proximate the housing 400. In this aspect, the thermal assembly 300 is in thermal communication with the dissipation member 450. The dissipation member may, for example, comprise a thermally conductive material. The dissipation member may also comprise a plurality of fins 460 with which to increase the surface area of the dissipation member and enable enhanced dissipation of thermal energy.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. The corresponding structures, materials, acts, and equivalents of all means or step plus function elements in the claims below are intended to include any structure, material, or acts for performing the functions in combination with other claimed elements as specifically claimed.

Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

I claim:

1. A lighting assembly for use with an induction lamp having an engagement end, the lighting assembly comprising:

a mount body configured to receive the engagement end of the lamp, wherein the mount body defines at least one bore extending at least partially therethrough the mount body; and a thermal assembly, wherein a proximal portion of the thermal assembly is mounted therein at least a portion of the at least one bore of the mount body and is in thermal communication with the mount body to form a thermal circuit between the lamp and the thermal assembly, and wherein the thermal assembly comprises a variable conductance heat pipe.

2. The lighting assembly of claim 1, wherein the thermal assembly is configured to dissipate heat from the lamp to the surrounding environment.

3. The lighting assembly of claim 1, wherein the thermal assembly is configured to selectively dissipate heat from the lamp to the surrounding environment.

4. The lighting assembly of claim 1, wherein at least a portion ofthe proximal portion of the thermal assembly extends therefrom the at least one bore.

5. The lighting assembly of claim 1, wherein a proximal portion of the thermal assembly is integrally mounted therein a portion of the mount body.

6. The lighting assembly of claim 1, wherein at least a portion of the proximal portion of the thermal assembly is connected to an exterior portion of the mount body.

7. The lighting assembly of claim 1, further comprising a lamp housing, and wherein the mount body is disposed within the lamp housing.

8. The lighting assembly of claim 7, wherein a portion of the thermal assembly is in thermal communication with a portion of the lamp housing.

9. The lighting assembly of claim 8, wherein the lamp housing is comprised of a thermally conductive material.

10. The lighting assembly of claims 8 or 9, wherein the external surface of the lamp housing comprises a plurality of fins.

11. The lighting assembly of claim 10, wherein a distal portion of the thermal assembly is embedded within at least a portion of the plurality of fins.

12. The lighting assembly of claim 10, wherein a distal portion of the thermal assembly is connected to at least a portion of the plurality of fins.

13. The lighting assembly of claim 11 further comprising a dissipation member located proximate the housing, wherein the thermal assembly is in thermal communication with the dissipation member.

14. A lighting assembly for use with an induction lamp having an engagement end, the lighting assembly comprising:

a mount body configured to receive the engagement end of the lamp; and a heat pipe, wherein at least a portion of a proximal portion of the heat pipe is embedded within the mount body and is configured to be in thermal communication with the mount body to form a thermal circuit between the lamp and the heat pipe, and wherein the heat pipe is configured to selectively dissipate heat from the lamp to the surrounding environment.

15. The lighting assembly of claim 14, wherein the heat pipe is configured to dissipate heat from the lamp to the surrounding environment.

16. The lighting assembly of claim 14, wherein the heat pipe is a variable conductance heat pipe.

17. The lighting assembly of claim 14, further comprising a lamp housing, wherein the mount body is disposed within the lamp housing, and wherein a portion of the heat pipe is in thermal communication with a portion of the lamp housing.

18. The lighting assembly of claim 17, wherein the external surface of the lamp housing comprises a plurality of fins, and wherein a distal portion of the heat pipe is embedded within at least a portion of the plurality of fins.

19. The lighting assembly of claim 18, wherein a distal portion of the heat pipe is connected to at least a portion of the plurality of fins.

* * * * *